United States Patent [19]

Kudo

[11] 4,270,192

[45] May 26, 1981

[54] ELECTRONIC TIMEPIECE

[75] Inventor: Yasuhiko Kudo, Suwa, Japan

[73] Assignee: Kabushiki Kaisha Suwa Seikosha, Tokyo, Japan

[21] Appl. No.: 9,556

[22] Filed: Feb. 5, 1979

[51] Int. Cl.[3] ..... G04B 19/24; G09F 9/00

[52] U.S. Cl. ..... 368/29; 340/756

[58] Field of Search ..... 58/4 A, 23 R, 50 R, 58/58, 85.5, 152 R, 38 R, 38 A, 57.5, 152 B; 364/705; 368/28, 30

[56] References Cited

U.S. PATENT DOCUMENTS

| | | | |
|---|---|---|---|
| 3,834,153 | 9/1974 | Yoda et al. | 58/57.5 |
| 3,922,842 | 12/1975 | Fujita | 58/4 A |
| 3,999,050 | 12/1976 | Pitroda | 58/152 R |
| 4,104,865 | 8/1978 | Sasaki | 58/38 R |
| 4,152,768 | 5/1978 | Kuriya | 58/4 A |
| 4,170,870 | 10/1979 | Burdet | 58/58 |

*Primary Examiner*—Vit W. Miska

*Attorney, Agent, or Firm*—Blum, Kaplan, Friedman, Silberman & Beran

[57] ABSTRACT

An electronic wristwatch with time and full calendar displays is programmed to uniquely display specially selected dates in the year using three manually operated input terminals. A terminal operation enables the memory to receive or erase special date data which is visible on the watch face at the time of selection. Month to month progression in the calendar display mode and day to day progression on the display in the write-in or erase mode is rapidly accomplished using two terminals.

13 Claims, 9 Drawing Figures

ELECTRONIC TIMEPIECE

BACKGROUND OF THE INVENTION

This invention relates generally to an electronic timepiece used to display the time of day and a calendar and more particularly to a timepiece where specially selected days are uniquely displayed on the calendar so as to draw the user's attention to the specially selected days. In recent years, great progress has been made in combining multifunctions into electronic timepieces beyond the ordinary indications of time. Watches which display a calendar are now quite common. One supplemental function of such an electronic timepiece with a calendar provides a capability where optionally selected special dates are memorized and the special dates are uniquely indicated on the calendar display. However, in such a trend to provide electronic timepieces with a large plurality of supplemental functions, it is undesirable, in view of the effect on appearance design, cost, and the like, to unnecessarily increase the number of operating input terminals, e.g. external buttons on the side of the watchcasing, which are needed to accomplish these supplemental functions. This is especially true where it is desired to display special dates throughout an entire year.

What is needed is an electronic timepiece wherein special dates may be selected for an entire year using input terminals similar in appearance and operation to those now used in conventional electronic timepieces. It is also desirable that the specially selected dates be easily recognized without adding special display elements to indicate those special dates.

SUMMARY OF THE INVENTION

Generally speaking, in accordance with this invention, an electronic timepiece having means for effectively performing the selection or removal of special dates for unique display in a calendar using a limited number of operating input terminals is provided. The electronic timepiece with time and full calendar displays is programmed to uniquely display specially selected dates in the year using three manually operated input terminals. A terminal operation enables the memory to receive or erase special date data which is visible on the watch face at the time of selection. Month to month changes and day to day progression on the display in the input or erase modes is rapidly accomplished using two terminals.

Accordingly, it is an object of this invention to provide an electronic timepiece which uniquely displays specially selected dates of the calendar.

Another object of this invention is to provide an electronic timepiece which stores or erases data on dates selected for special display using a minimum number of manually operated input terminals.

A further object of this invention is to provide an electronic timepiece where the specially selected day is visible on the face of the timepiece before it is committed to memory.

Still another object of this invention is to provide an electronic timepiece wherein special days may be selected quickly over an entire year.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
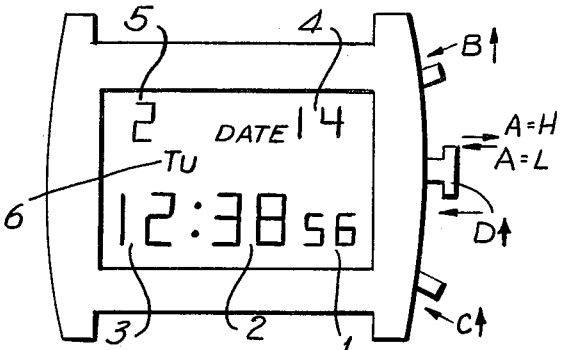
FIG. 1 is a front view of the timepiece of this invention in a normal time display condition.

FIG. 1 shows the electronic timepiece of this invention in the time display condition or mode. As explained more fully hereinafter this timepiece operates in at least three modes, three modes being sufficient for the implementation of this invention. As mentioned above, electronic wristwatches may display many functions. For the purposes of this disclosure only the time indicating mode and the calendar display condition or mode, in various forms, are of particular interest. For this reason the discussion is limited to those special conditions. In the time display condition the face of the watch indicates the month 5, the day of that month 4, the day 6 (Tu), hour 3, minutes 2 and seconds 1. It can be seen from FIG. 1, which is an example of any day which might have been used for purposes of describing this invention, that the present day is Tuesday, February 14, and it is 38 minutes and 56 seconds past the hour of 12.

Figure 3:
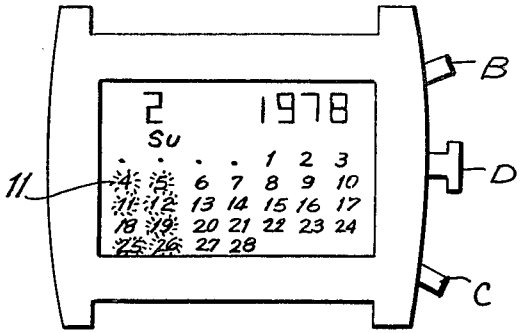
FIG. 3 is similar to FIG. 2 and shows alternative means for indicating specially selected dates by flickering.
Figure 2:
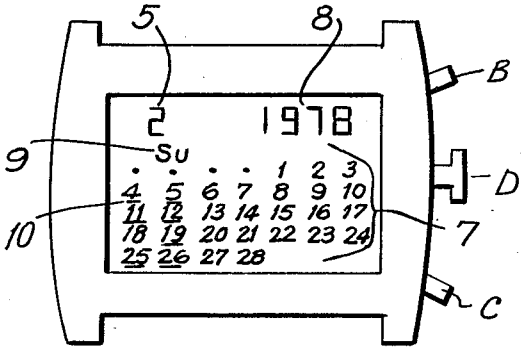
FIG. 2 is a front view of the timepiece of FIG. 1 in the calendar display condition and uniquely indicating specially selected dates.

The second display condition or mode, that is, the calendar display condition, is shown in FIGS. 2 and 3. In this mode are displayed the days of the month 7, the year 8, the month 5, and a marker 9 indicating Sunday. Specially selected days within the month are indicated by a marking 10 which underlines the specially selected date. Thus in FIG. 2, in the calendar display mode, we see that the displayed calendar is for the second month of 1978 having 28 days, and having its first Sunday fall on the 5th day of the month. Every Sunday in the month has been indicated as a specially selected date by underlining, as well as three additional specially selected dates, namely, the fourth, the eleventh and the twenty-fifth day of the month. In a manner which is well-known in the art of electronic wristwatches the number of days indicated in the calendar display is modified appropriately for the month which is being displayed. Thus, while February as shown in FIG. 2 has 28 days, other months will show appropriately 30 or 31 days. Also, the SU marking 9 which indicates the position of Sunday in the month is available over each vertical column of date numerals. However, only the marking 9 is illuminated which is appropriate to the particular month and year. Again, in the known manner, all months of the year are represented by altering the number of days between 28 and 31, and by illuminating the Sunday marking 9 at the appropriate position. The numbers 1 through 28 remain in a fixed position regardless of which month is displayed.

Whereas in FIG. 2 specially selected dates are indicated by underlined markings 10, in FIG. 3 the specially selected dates are indicated by flickering those selected dates as indicated by the marking 11. The specially selected dates of FIG. 2 and FIG. 3 are identical except for the manner of uniquely calling attention to the special dates. The external member D of FIGS. 1, 2 and 3 has three positions. In a neutral position, as explained more fully hereinafter it represents a Low condition. When pressed in, the D terminal causes the display to shift from the time condition shown in FIG. 1 to a calendar display condition as shown in FIG. 2 or FIG. 3 depending on the design of the wristwatch. When extracted beyond the neutral position, the terminal D sets up in the internal circuitry a High condition.

Figure 4:
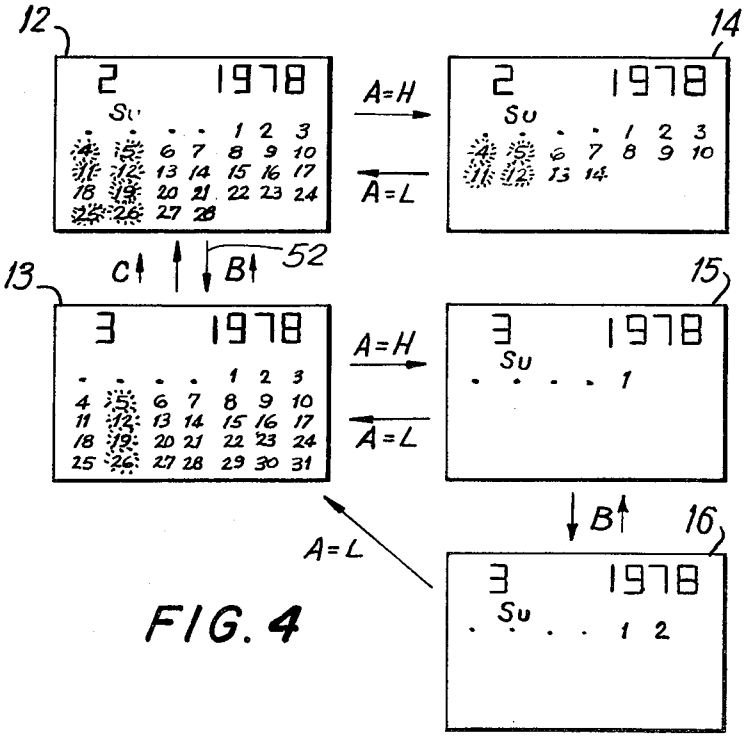
FIG. 4 is an exemplary flow diagram indicating a change of conditions between calendar display and write-in or erasing.
Figure 5:
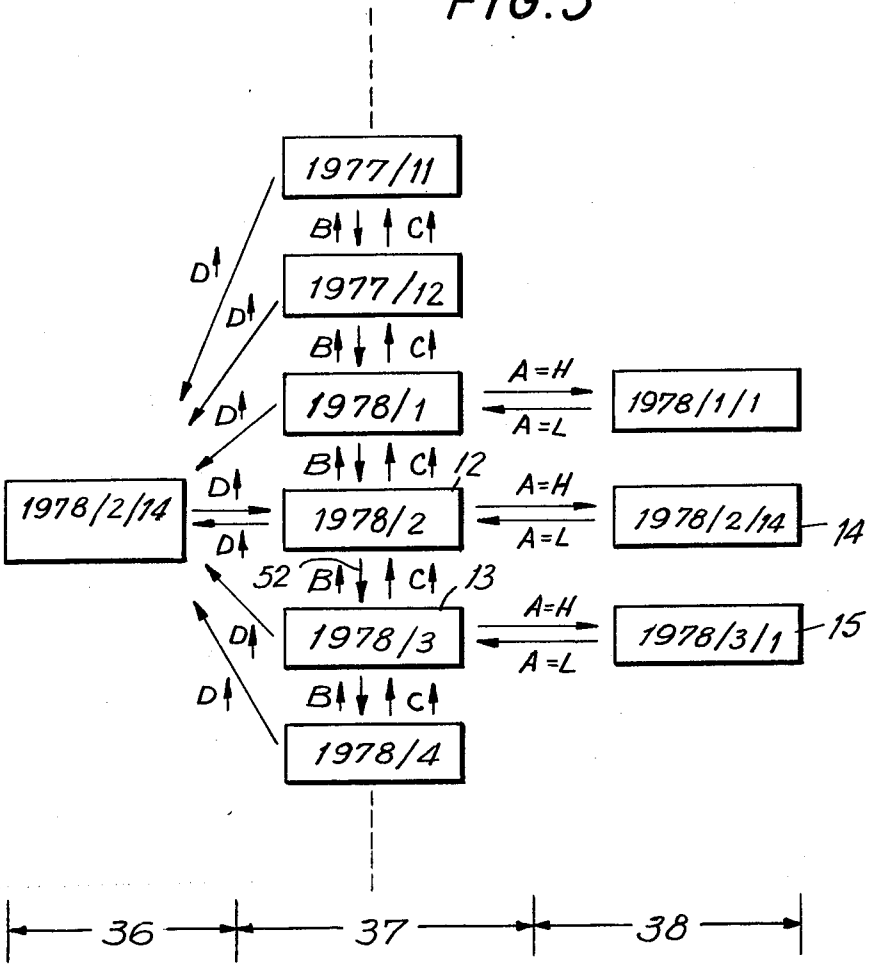
FIG. 5 is a flow diagram indicating the interrelationship between the three operating modes of the timepiece of FIG. 1.

Once the display is in the second mode 37 for calendar display, by actuation of the terminal D, the month which is displayed can be changed by pressing the B or the C terminal. The present month of February 1978 produced on the display by pressing in the D terminal, is changed to the next later month, that is March 1978, by actuating the B terminal as indicated by the arrow 52 in FIGS. 4 and 5. Instantly the condition of the calendar 12 changes to the condition of the calendar 13, indicating the special days by flashing in each month. As best seen in FIG. 5, for each actuation of the B button terminal the display advances by one month and shows in illuminated fashion that later month. Actuation of the C terminal when the timepiece of this invention is in the calendar display mode 37 will revert the display to show the next preceding month. Thus, the months of the calendar can be displayed in progression one after the other, moving either ahead or backward in illuminating a displayed month. It should be noted in FIG. 5 that pressing of the D terminal, will return the timepiece from the calendar display condition 37 back to the time display condition illustrated in FIG. 1.

When it is desired to change the special dates which were stored for unique display in the memory of the timepiece, the timepiece is placed in the calendar display condition 37 and then placed into the write-in or erase condition 38 by pulling out the terminal D to produce the High condition as stated above. Two basic conditions may arise at this moment. As illustrated in FIG. 4, when the calendar display is showing the present month, i.e, the display referenced with the numeral 12 in FIG. 4, creating a High condition by means of terminal D causes the face of the timepiece to show only a portion of the full calendar for that month. The display will indicate every day from the beginning of the month up to and including the present day which in this example is the 14th of February, 1978. This display condition 38 indicates all of the specially selected days in their flickering mode up to and including the fourteenth of the month. This display is indicated in FIG. 4 by the reference numeral 14 and in FIGS. 5 and 7 by the reference numeral 14. Now actuation of the B terminal will add one day to the illuminated display 14, as indicated functionally by the reference numeral 55 in FIG. 7. Thus the number 15 will be illuminated along with the other fourteen numbers on the face 14. After the day has been advanced, one day at a time, by actuation of the B terminal in the write-in or erase condition 38, the last date becomes a selected date by returning the D terminal 50 to its Low or neutral condition. Thus continuing with the present example, if the present day is February 14, 1978 and the D terminal is pressed in, the display will indicate the calendar for February as shown in FIG. 3. Placing the D terminal in the High condition will then change the display so that it illuminates only the days up to and including the 14th of the month which is the present day. Then one actuation of the B terminal will add illumination to the fifteenth day of the calendar, and finally return of the D terminal to its Low or neutral condition will produce the calendar display mode 37 with the fifteenth of the month now displayed as a unique special day. In the example used, that day would flicker along with all other specially selected days. The procedure can then be repeated to add other specially selected days in the month of February and the B terminal is actuated until the desired date for special selection is displayed on the face of the watch in condition 38.

The other basic condition arises when special days are to be inserted or removed from a month which is not the actual present month, that is, in the example, not February. As stated above, the display is placed in the calendar display mode 37 by pressing of the D terminal, and then the display is advanced to the month in which it is desired to modify the specially selected dates. This is accomplished by actuating the B or C terminal. When the desired month is displayed on the face of the wristwatch, the write-in or erase condition 38 is produced by placing the D terminal in the High condition. Because the selected month is not the present month, the display now shows an indication of the desired month with only the first day illuminated. This is best illustrated by an example. If it should be desired to make a modification in the specially selected days in the month of March 1978, as illustrated in FIG. 4 by the reference numeral 13, then the timepiece is moved from the time condition mode 36 to the calendar display mode 37 by pressing the D terminal. Then the month of February will be displayed. This display is changed to March by a single actuation of the B terminal as illustrated by the arrow 52 in FIG. 4. Now placing the D terminal in the High condition puts the display in the condition identified by reference numeral 15 in FIGS. 4, 5, 6, that is, only the first day of March 1978 is indicated. It should be noted that the marker showing where the Sunday falls relative to the first day is also shown. By actuating the B terminal at this time an additional day is illuminated on the display as indicated by reference numeral 16, and additional days may be added one at a time by repetitive actuation of terminal B. When the desired date for special display is reached, this date is stored in a memory, as explained more fully hereinafter, by returning the D terminal to its Low or neutral condition.

It should be noticed that in each instance, whether dealing with the present month or another month, the days may be advanced through the entire month one day at a time since a return loop is provided. When the last day of the month is displayed, one more actuation of the B terminal will display the first day of the month. The return loop is indicated by the reference numeral 56 in FIGS. 6 and 7.

Figure 6:
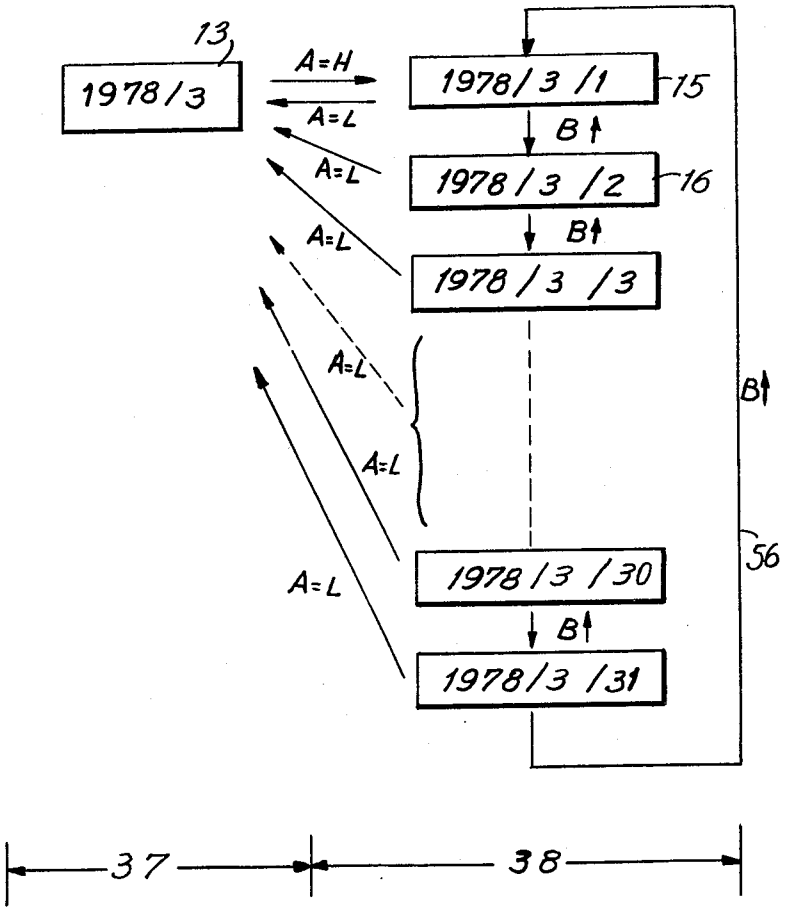
FIG. 6 is a flow diagram illustrating the date selection process.
Figure 7:
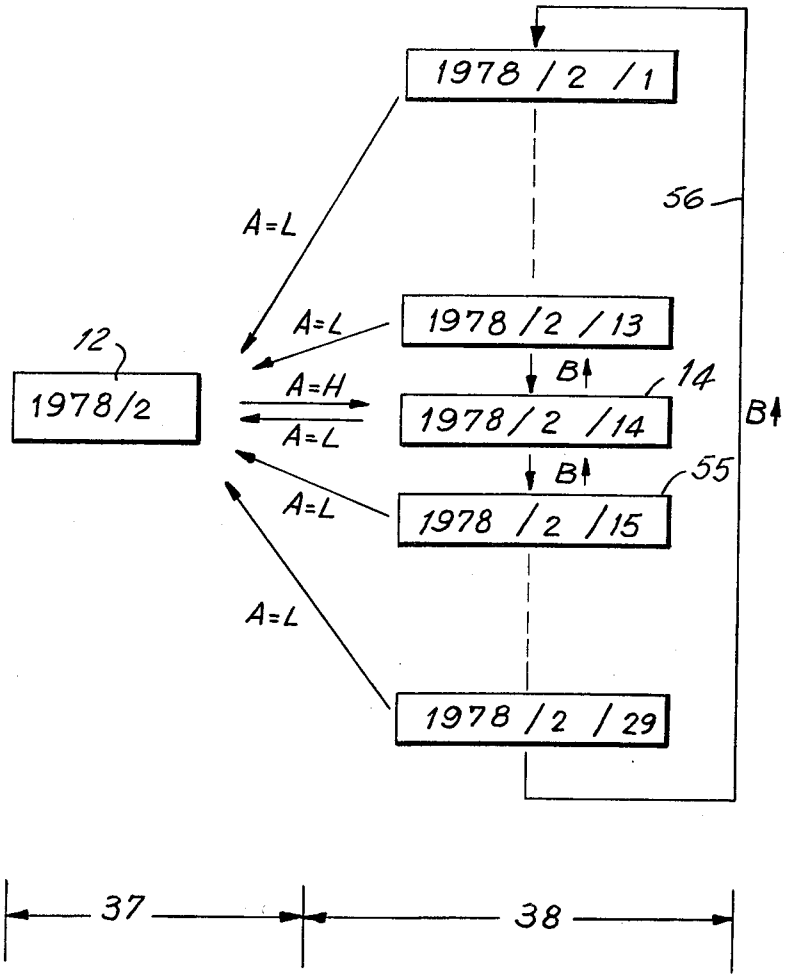
FIG. 7 is a flow diagram illustrating the special case in date selection where special dates are selected in the present month.

In summarizing, FIG. 1 shows a condition 36 wherein time is displayed, and accordingly it can be seen that the present day in this example is February 14, 1978. When the operating input terminal D is pressed in with the timepiece in the above-mentioned time condition 36, a second condition 37, that is the calendar display condition is displayed as shown in FIGS. 2 and 3. The dates which have been stored in memory as particular or special dates for this month are shown on the watch face by providing an indicator as shown in FIG. 2 by underlining or by making the special dates flicker as shown in FIG. 3. In this calendar display condition 37, when the operating input terminal D is pulled out to produce a High condition in the circuit, it is possible to write-in or erase particular dates among the dates displayed in the calendar display condition 37. When the present date, month and year are showing in the above-mentioned calendar display condition 37, as shown in FIG. 7, then the write-in or erase condition produced by placing the terminals D in the High condition shows the calendar only up to and including the present date. If the displayed month in the calendar display mode 37 is not the present month because of actuation of the terminals B or C, then as shown in FIG. 6, only the first day of the calendar month is shown illuminated. In both cases, selection of dates to write-in or erase starts from the above-mentioned displayed date. The month and year are selected as shown in FIG. 5 in the calendar display condition 37 by operating the terminals B and C on the watchcase. As shown by the conditions 14, 15 and 16 in FIG. 4 and functionally in the flow diagrams, the dates following the last displayed date are not illuminated, so the selected date is readily visible to the user as the last illuminated date prior to his inputting the selected date to memory by actuation of the D terminal.

Figure 8:
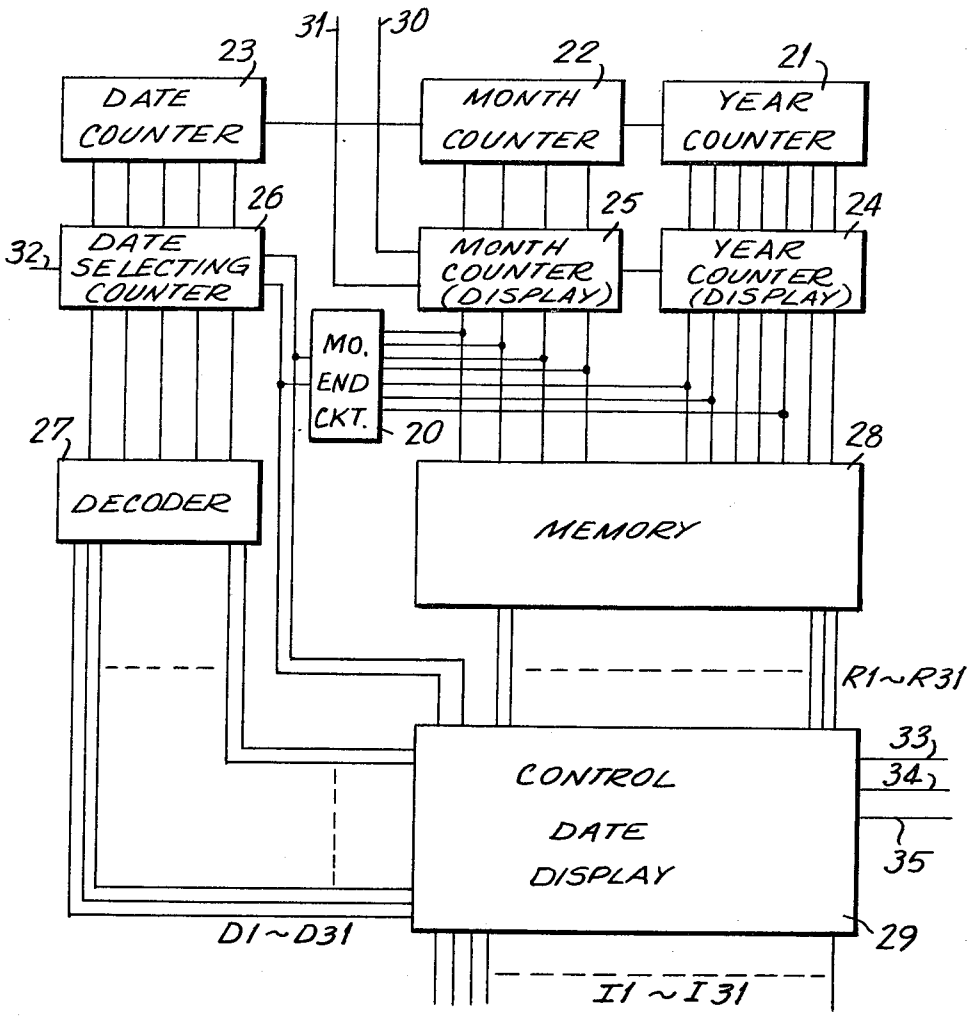
FIG. 8 is a functional block diagram of the circuits for selecting and presenting special dates in the timepiece of FIG. 1.

In FIG. 8, the year counter 24 is used for calendar display and the month counter 25 is also used for calendar display. The contents of year counter 21 and month counter 22 are written respectively into the counters 24, 25 when the mode is changed to display the calendar. The month and year to be displayed are selected by signals 30 and 31. When the contents of the year counter 21 and month counter 22 correspond to the contents of year counter 24 for calendar display and month counter 25 for calendar display, the contents of the date counter 23 are written in the date selecting counter 26. When the contents of the year counter 21 and month counter 22 do not correspond to those of the year counter 24 for calendar display and month counter 25 for calendar display, the date selecting counter 26 is reset to the first day. The address designation in the memory 28 for storing particular dates is accomplished by month and year. The memory 28 for storing particular dates, outputs the data representing date in parallel on lines R1 to R31. The outputs I1 to I31 from the control 29 for date display are fixed to be illuminated, or not to be illuminated, or to flicker on the special dates by means of data R1 to R31 from the memory 28, and by signals 33, 35 for controlling the date display 29, flicker signal 34, and outputs D1 to D31 from the date selecting decoder 27.

Figure 9:
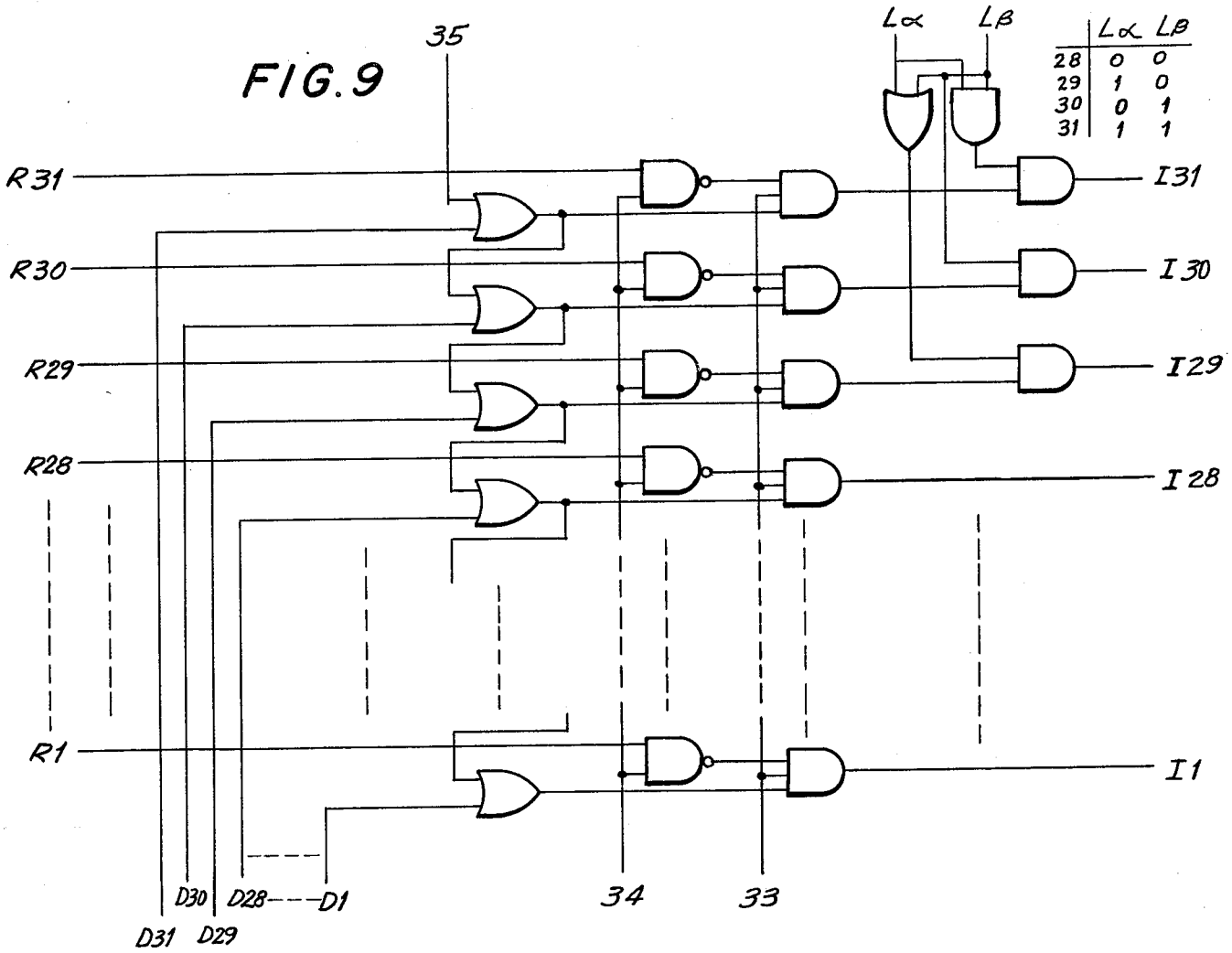
FIG. 9 is a logic circuit for date display control.

FIG. 9 shows an example of the date display control circuit 29. The date display control signal 33 is at a High level in the calendar display condition 37 and in the write-in or erase condition 38 for selected dates. The date display control signal 35 is at a High level in the calendar display condition 37. The flicker signal 34 is a signal to make particular dates flicker on display. $L\alpha$ and $L\beta$ are month and judging signals which determine the last day of the month for display and provide the return loop of the date selecting counter as discussed above.

This invention provides an efficient and simple operating method in an electronic timepiece for setting special dates for display by operating terminals similar to those normally used on conventional electronic timepieces. Much additional data is displayed without an increase in the external terminals. Moreover, because the last illuminated date in the write-in or erase condition mode 38 corresponds to the specially selected date, this invention provides a display method whereby the selected date can be seen by the user before it is committed to memory.

Please note that there "High" and "Low" have been used in the text, these conditions are represented on the drawings by the sumbols H and L respectively. Further it should be understood that in alternative embodiments of this invention modes to indicate special dates other than underlining and flickering may be used without departing from the scope of this invention. Also, it should be apparent that whereas in the text above certain functions were initiated by pushing terminals in or pulling terminals out, these motions are arbitrarily chosen as illustrative examples, and the invention is not limited by the mechanical motions of the terminals or by the particular terminal used for each function.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece including:

timekeeping means for generating timekeeping data and calendar data indicative of the present month and day;

means for storing data representative of calendar month;

display means for visibily presenting said timekeeping and calendar data;

control means for selecting data for presentation by said display means, whereby data identifying present month and day is displayed by said display means, or in the alternative, data of calendar months is selectively displayed, showing simultaneously all days of a selected month;

means for uniquely indicating special dates when said calendar months are displayed, all special dates in a selected month being simultaneously and uniquely indicated, said control means being adapted to modify the display of said selected calendar month whereby any number of special dates are entered or erased from any selected calendar month display by the performance of external operations by the user of said timepiece, said modification of said display causing only a first portion to be displayed of the dates in the calendar month while a second portion of said calendar dates is not displayed, said second portion being subsequent to said first portion of dates.

2. The electronic timepiece of claim 1, wherein said unique indication of special dates is presented by underlining in said calendar display.

3. The electronic timepiece of claim 1, wherein said special dates are uniquely indicated by flickering of said dates in said calendar display.

4. The electronic timepiece of claim 1, wherein said control means are further adapted to write-in for said unique display the last of said displayed dates in said first portion, said write-in being initiated by performance of an external operation.

5. The electronic timepiece of claim 4, wherein said control means displays an additional date in said first portion, said display of an additional date being initiated by performance of an external operation, whereby said additional date is in condition for write-in as a special date.

6. The electronic timepiece of claim 5 and further including means for varying the number of dates which can be added to said first portion in accordance with the last date actually occuring in the named month for display.

7. The electronic timepiece of claim 6, wherein, when the last date of the calendar month is displayed in said first portion, the performance of an additional external operation causes said display to be cleared of the dates of said calendar month except for the first date of said calendar month, whereby all the dates of a month are available for said selection as special dates.

8. The electronic timepiece of claim 7, wherein said selection process may be repeated continuously by the addition, one date at a time, of dates to said first portion until the last date of said month is reached and then looping back to said first date and continuing the process.

9. The electronic timepiece of claim 8, wherein said first portion originally includes only one displayed date, said one displayed date being the first date of the displayed month, said second portion comprising all the remaining dates of said month, said second portion being undisplayed, whereby the selection process begins from the first date and proceeds one date at a time.

10. The electronic timepiece of claim 8, wherein said calendar month to be modified is the present month, and said first portion initially displays all the dates of said present month from the first date through the present date, and said second portion includes all the dates after said present date until the last date of said present month, whereby said selection of special dates begins with the present date and proceeds one date at a time until all dates of the month after said looping back have been presented for selection as special dates.

11. The electronic timepiece of claim 1, 9 or 10, wherein said timekeeping means generates data indicative of year, and displayed calendar months include a marker representative of the Sunday dates of the month, said Sunday markers being movable on said display by said control means, whereby calendar months for many years may be displayed accurately using a fixed pattern of dates, said fixed pattern being modified only as to the dates following the 28th date of the month.

12. The electronic timepiece of claim 1, 9 or 10, wherein said timekeeping data further includes hours, minutes and seconds, said hours, minutes, seconds being displayed along with said present month and day.

13. The electronic timepiece of claim 1, wherein said display means illuminates said data for display.

* * * * *